US006161379A

United States Patent [19]

Haselkorn et al.

[11] Patent Number: 6,161,379

[45] Date of Patent: Dec. 19, 2000

[54] METHOD FOR SUPPORTING A CERAMIC LINER CAST INTO METAL

[75] Inventors: Michael H. Haselkorn, Dunlap; Michael C. Long, Peoria, both of Ill.

[73] Assignee: Caterpillar Inc., Peoria, Ill.

[21] Appl. No.: 09/213,712

[22] Filed: Dec. 17, 1998

[51] Int. Cl.[7] ..... F01N 7/10

[52] U.S. Cl. ..... 60/323; 60/272; 60/282; 428/114; 264/101

[58] Field of Search ..... 60/272, 323, 282; 29/149.5 C; 501/104, 102; 428/114, 312.4; 164/98

[56] References Cited

U.S. PATENT DOCUMENTS

| | | | |
|---|---|---|---|
| 4,206,598 | 6/1980 | Rao et al. . | |
| 4,398,330 | 8/1983 | Meadows | 29/149.5 C |
| 4,676,064 | 6/1987 | Narita et al. . | |
| 4,751,206 | 6/1988 | Yamai et al. | 501/102 |
| 4,869,943 | 9/1989 | Corbin et al. | 428/114 |
| 5,102,836 | 4/1992 | Brown et al. | 501/104 |
| 5,404,716 | 4/1995 | Wells et al. . | |
| 5,552,196 | 9/1996 | Haselkorn et al. . | |
| 5,842,342 | 8/1983 | Strasser et al. | 60/282 |
| 5,888,641 | 3/1999 | Atmur et al. | 428/312.4 |
| 5,964,273 | 11/1999 | Strasser et al. | 164/98 |
| 6,030,563 | 2/2000 | Strasser et al. | 264/101 |

*Primary Examiner*—Thomas Denion
*Assistant Examiner*—Thai-Ba Trieu
*Attorney, Agent, or Firm*—Kathleen M. Ryan

[57] ABSTRACT

An improved apparatus for withstanding the high temperatures in the exhaust assembly of an internal combustion engine. A quilted insulating element is extended about a liner of a manifold or port liner. The liner in this invention is preferably ceramic. After assembling the insulating element about the liner, a metallic ring is installed for support during casting. A metallic housing, preferably cast iron, can then be cast around the liner, insulating element, and metallic ring.

20 Claims, 5 Drawing Sheets

METHOD FOR SUPPORTING A CERAMIC LINER CAST INTO METAL

TECHNICAL FIELD

This invention relates generally to a ceramic liner for use in an internal combustion engine and more particularly to a ceramic liner for use in exhaust manifolds, port liners, or other high temperature applications.

BACKGROUND ART

Present day engine components must be manufactured more simply at significantly reduced costs while achieving superior results in order for engine manufacturers to remain competitive. Unfortunately, exhaust manifolds and port liners that have become less complicated have either failed to produce superior heat insulation capabilities or have become less durable, increasing associated replacement costs.

The heat-insulated port liner for a device composed of a cast metal disclosed in U.S. Pat. No. 4,676,064 by Yoshinori Narita et. al. on Jun. 30, 1987 includes a tubular port liner composed of a ceramic material, a first covering layer disposed on the outer surface of the liner and composed of refractory fibers, and a second covering layer disposed on the outer surface of the first covering layer and composed of a metal having a melting point not lower than the melting point of the cast metal. The port liner is made from a material having a low coefficient of thermal expansion and high thermal resistance, such as, aluminum titanate. Unfortunately, no range is given for the coefficient of thermal expansion needed for the port liner used with a cast aluminum cylinder head. It is well known that the melting point of aluminum is lower than that of cast iron and that aluminum titanate can be effectively used with molten aluminum. However, aluminum titanate may only be successfully cast in very simple geometries due to the additional stresses it will encounter upon exposure to molten cast iron. Further, the stability of aluminum titanate varies with the composition. The port liner disclosed by Narita could be destroyed during the casting process if used with a cast iron cylinder head, depending upon the complexity of the geometry and the composition of the aluminum titanate.

Additionally, since the first covering layer is unsupported, settling of the refractory fibers occurs when the fibers are exposed to typical engine vibration experienced during operation. This settling effect limits the effectiveness of the insulation and may lead to the destruction of the entire insulation layer. Once destroyed, the insulation would be free to disintegrate and enter the exhaust passage.

A method and apparatus for insulating the exhaust passage of an internal combustion engine is disclosed in U.S. Pat. No. 4,206,598 by Vemulapalli D. Rao on Jun. 10, 1980. A three-zone liner assembly is provided with an outer zone comprised of a room temperature vulcanizing silicone sleeve, an inner zone comprised of a stamped and seam welded high strength Al—Cr-steel alloy, and an intermediate zone consisting of a ceramic wool mat. The Al—Cr-steel alloy utilized has high thermal expansion, which would cause problems in use as an exhaust manifold or port liner, due to the high temperature applications and the thermal growth differences relative to the cylinder head. The Al—Cr-steel alloy material could fatigue and crack at those temperature ranges unless exhaust bellows or slip joints are used in conjunction with the Al—Cr-steel alloy material. The exhaust bellows and slip joints are undesirable due to cost and gas leakage. Also, the intermediate zone consisting of the ceramic wool mat of insulation is encased within the seam welded inner zone of metal protecting the insulation from damage. However, if the weld fails, the insulation is subjected to possible damage which, as with Narita, would cause disintegration of the insulation and destruction of the entire insulation layer.

Further, with the above insulation element, the insulation is applied externally to the exhaust manifold or port liner. This creates service difficulty when the insulation needs to be replaced every 3000 to 5000 hours.

An improved apparatus for insulating the exhaust passage of an internal combustion engine is disclosed in U.S. Pat. No. 5,404,716 by Alan W. Wells et al. on Apr. 11, 1995. The insulating element is quilted and has ceramic fiber encased within fiberglass. This insulating element is then extended about the liner of a manifold. The liner in this invention may be ceramic or stainless steel, preferably stainless steel. A housing can then be cast or assembled around the liner and insulating element. An apparatus and method for insulating port liners was disclosed in U.S. Pat. No. 5,552,196 by Micheal H. Haselkorn et al. on Sep. 3, 1996. A ceramic port liner is surrounded by an insulating blanket, as described in U.S. Pat. No. 5,404,716. The ceramic port liner and surrounding blanket can then be cast within a cylinder head. During the casting process, the ceramic port liner remains in a softened state.

Neither the Wells et al. and Haselkorn et al. patents address the important issue of supporting the cast-in-place liner made of ceramic material. Casting the housing around the ceramic material requires special venting that is not disclosed in either patent.

In addition, there are other problems associated with casting the ceramic liner, wrapped in insulation, into cast iron. These include: sealing, venting, and support.

During casting, the cast iron must not contact the ceramic liner. The molten iron will thermally shock the ceramic material and cause failure. If the ceramic survives the thermal shock, then the solidification and shrinkage(thermal contraction) during cooling will compress the ceramic and cause either the ceramic or cast iron to fail.

Venting is also a problem. The insulation contains a large volume of air that expands when heated by the molten iron. The expanding air will cause large porosity defects in the cast iron if the air is not vented properly. The ceramic liner is impervious to air and prevents the normal venting of the insulation through the sand cores. Therefore, alternative venting routes have to be supplied.

Finally, the ceramic liner needs to be supported after casting. The ceramic liner must be permanently located within the cast iron housing. If the ceramic liner is cast-in without the iron contacting it, the ceramic is essentially floating free, held in place only by the compression of the insulation by the cast iron. The insulation compression may provide some support, by not sufficient support for long-term operation/resistance to engine vibration.

The present invention is directed to overcoming the problems as set forth above.

DISCLOSURE OF THE INVENTION

The manifold or port liner of this invention is of simple construction, compact, adapts itself to flexibility in construction and is solely internally insulated and thereby provides increased durability. The insulating element is thin and thereby conveniently adapts itself for use where engine space is severely limited, as for example in most marine applications. The metallic ring provides support, venting and sealing during the casting process.

The metallic ring and end cap used for casting into metal have holes or clearance machined to vent the air from the insulation into the sand core.

The present invention, through the use of a liner, surrounded by an insulation layer, and supported by a metallic ring provides a simple, inexpensive and durable assembly and method to limit heat rejection for greater engine efficiency.

BEST MODE FOR CARRYING OUT THE INVENTION

Figure 1:
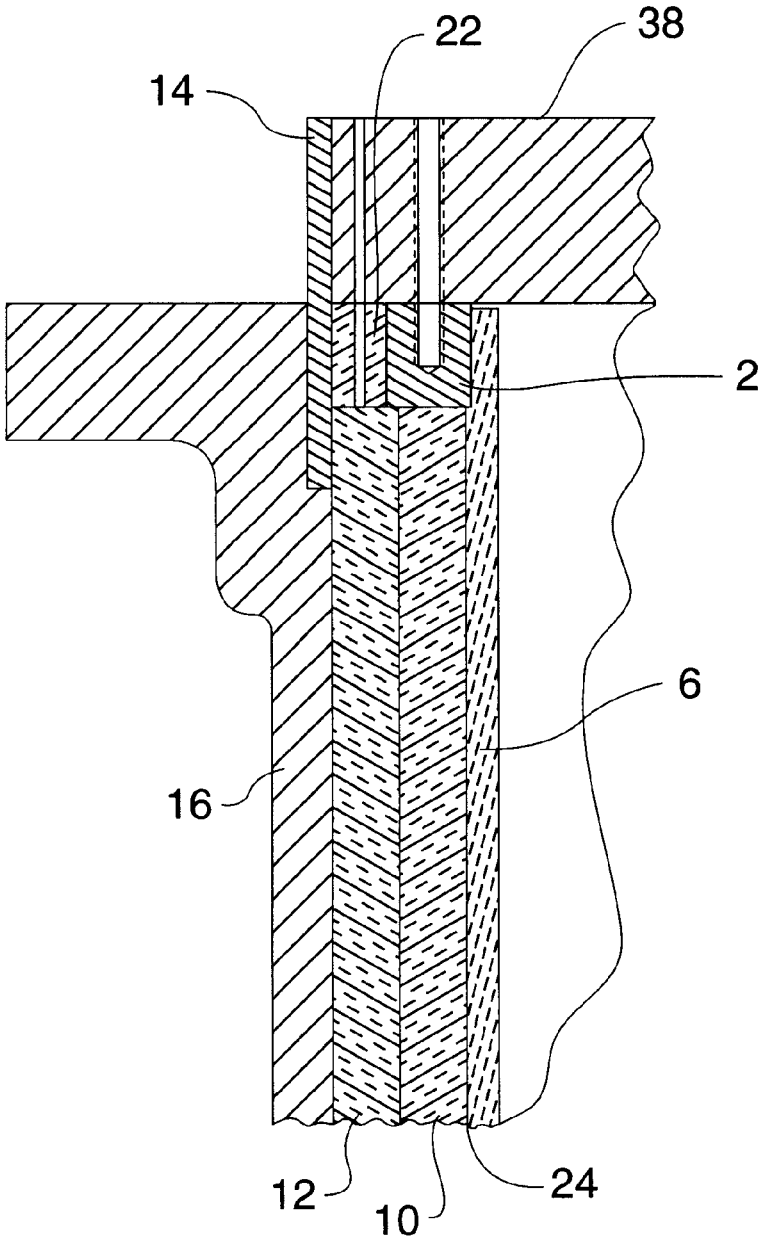
FIG. 1 is a cross-sectional view of a metallic support assembly.

Referring to FIG. 1, in the preferred embodiment of the invention, an exhaust manifold assembly is a double ring configuration, with two layers of insulating elements 10,12 and two metallic rings 2,14. The two separate insulating elements 10,12 are positioned about a liner 6 adjacent to one another and within an annulus 22. The liner 6 has an outer surface 24 and the insulating elements 10, 12 cover substantially the entire outer surface 24 of the liner 6. The insulating elements 10,12 of this invention provide sufficient insulation and the second metallic ring 14 seals a cast iron housing 16 from the layers of insulation 10,12 such that no excessive stress remains in the casting after solidification. Further, the annulus 22 formed between the first metallic ring 2 and the second metallic ring 14 contains a removable portion of insulating element 10 which can be removed and then filled with a post-cast insert 40 as shown in FIG. 2.

Figure 2:
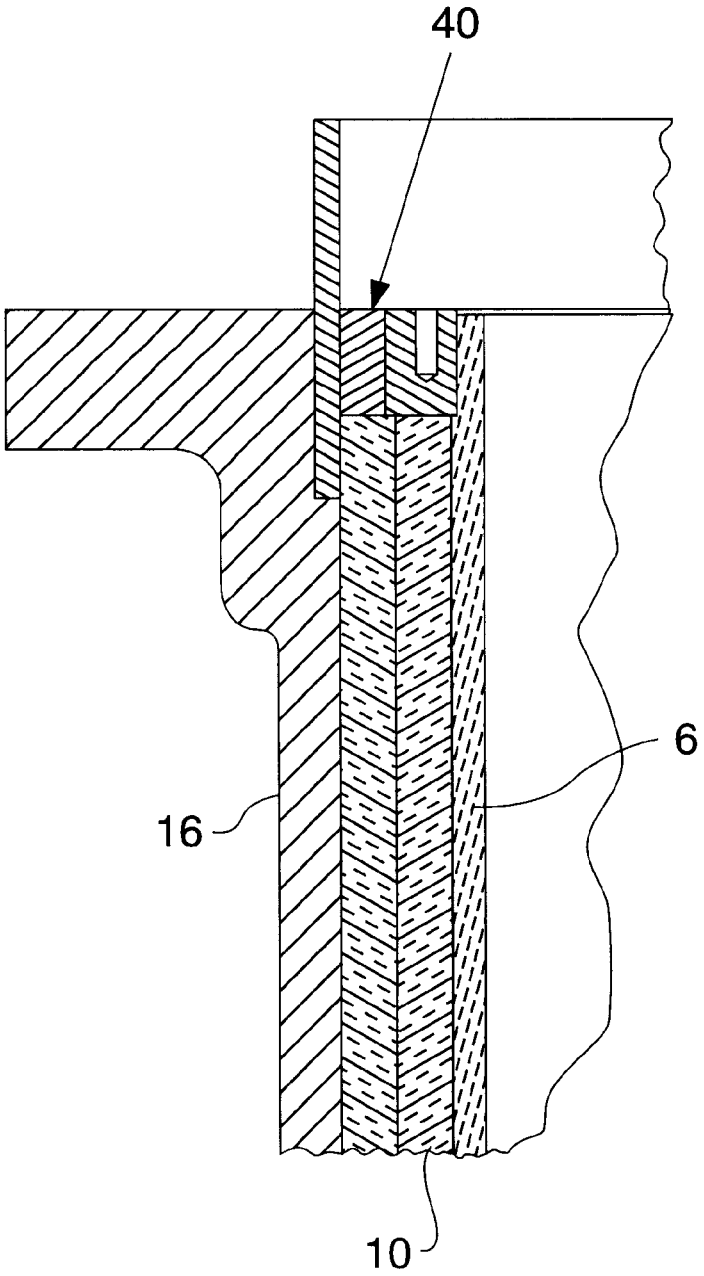
FIG. 2 is an enlarged cross-sectional view of FIG. 1 with a post-cast insert added after casting.

FIG. 2 depicts a post-cast insert 40, which is welded or joined to the existing metallic rings 2,14. The post-cast insert 40 is ceramic or metallic, preferably metallic with a thermal expansion equal to or less than cast iron. Preferably the dimensions of the post-cast insert 40 are in the range of about 0.5 mm in length to about 30.0 mm in length and about 2.0 mm in width to about 8.0 mm in width, more preferably the dimensions of the post-cast insert 40 are 10.0 mm in length and about 4.0 mm in width. The liner 6, insulating elements 10,12 and the cast iron housing 16 are shown. In regards to the insulating elements 10,12 of this invention, the construction of insulating element 10 has a thickness in the range of about 3.0 mm to about 15.0 mm, more preferably about 6.0 mm. As with insulating element 10, insulating element 12 has a thickness in the range of about 3.0 mm to about 15.0 mm, more preferably about 6 mm.

The insulating elements 10,12 are quilted and have a ceramic fiber 26 encased within fiberglass 28. The ceramic fiber 26 of the insulating elements 10,12 is one of alumino-silicate, mineral wool and refractory ceramic fibers, preferably alumino-silicate, and more preferably substantially shot free alumino-silicate. The insulating elements can be contained in a metal foil to aid in assembly.

Figure 3:
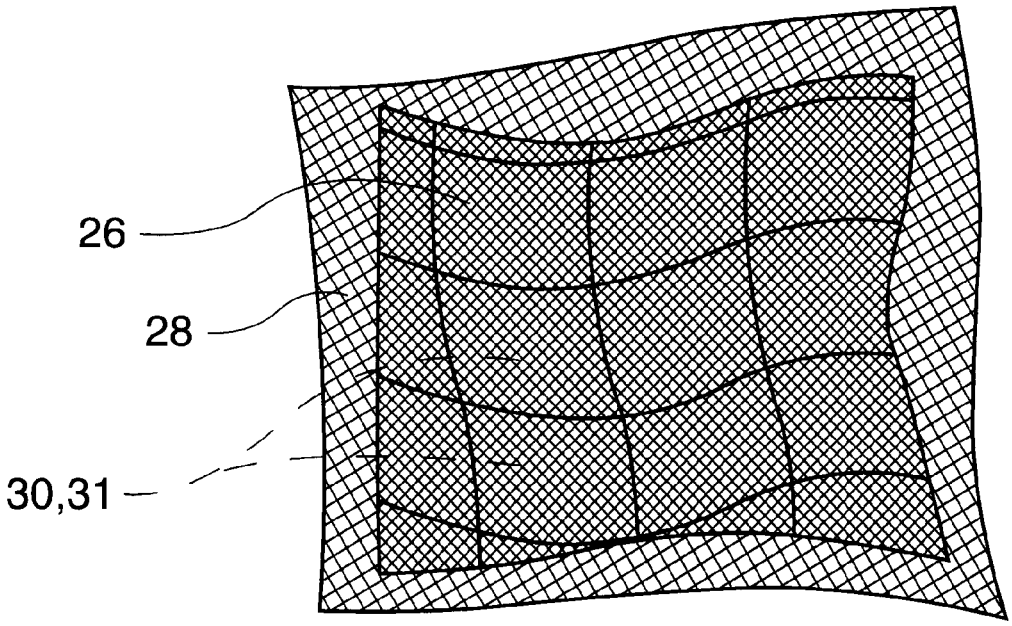
FIG. 3 is a diagrammatic view showing the fiberglass and ceramic fiber of a quilted insulating element.

Referring to FIG. 3, quilting of the fiberglass 28 defines separate pockets 30,31 of ceramic fiber 26. The pockets 30,31 have pocket dimensions in the range of about 12.7 mm length to about 254.0 mm in length and about 12.7 mm in width to about 254.0 mm in width. Preferably the dimensions of the pockets 30,31 are about 25.4 mm length and about 25.4 mm width.

Each insulating element 10,12 is quilted and has a ceramic fiber 26 encased within fiberglass 28. The ceramic fiber 26 of the insulating element 10 is one of alumino-silicate, mineral wool and refractory ceramic fibers, preferably alumino-silicate, and more preferably substantially shot free alumino-silicate. The insulating elements 10,12 can be contained in a metal foil to aid in assembly.

The fiberglass 28 of the insulating element of this invention is preferably fiberglass cloth and more preferably is bidirectional fiberglass cloth as is well known in the art.

The metallic ring 2, preferably stainless steel, also serves to vent the air from insulating elements 10,12 into the sand core. Referring to FIG. 1, an endcap 38 can be placed on either end of the sand core to support the assembly during casting and to further vent the air from the metallic ring 2 into the sand core. The venting has shown to be necessary in all previous castings to prevent large porosity defects.

In one aspect of the invention, again referring to FIGS. 1 and 2, the second metallic ring 14 is utilized to seal the cast metal housing 16 from the insulating elements 10, 12. The first metallic ring 2 is in contact with the ceramic for support with a post-cast insert 40, which is installed after the casting process. A portion of the insulating element 10 is removed and the post-cast 40 insert is subsequently installed.

Another embodiment contains a single metallic non-contact ring. Owing to the excellent insulating properties of insulating elements 10,12 of this invention, insulating element 10 had a thickness in the range of about 3.0 mm to about 15.0 mm, more preferably about 6.0 mm. As with insulating element 10, insulating element 12 has a thickness in the range of about 3.0 mm to about 15.0 mm, more preferably about 6.0 mm.

Figure 4:
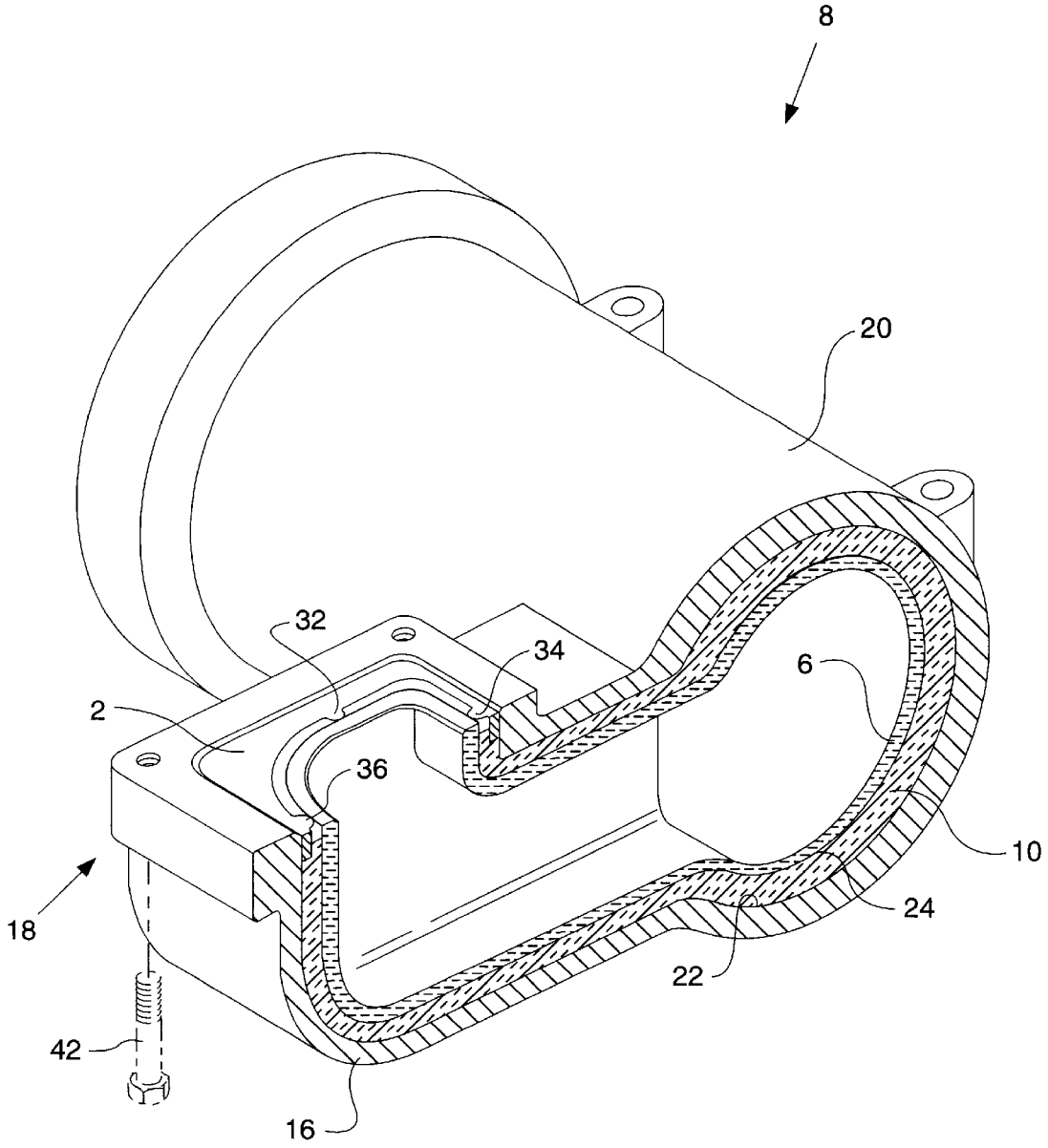
FIG. 4 is a cross-sectional view of an exhaust assembly.

Referring to FIG. 4, a single metallic ring embodiment, an exhaust assembly 8 is shown. A housing 16 is generally mateable with and about a liner 6. An annulus 22 is defined by the housing 16. The liner 6 is contained within the annulus 22. Insulating elements 10,12 are positioned about the liner 6 adjacent to one another within the annulus 22. The liner 6 has an outer surface 24 and the insulating elements 10,12 cover substantially the entire outer surface 24 of the liner 6. The insulating elements 10,12 of this invention provide sufficient insulation to maintain an outer surface 20 of the housing 16 at an acceptable temperature below about 200 degrees C. during operation of an engine(not shown in FIG. 4). Therefore, the outer surface 20 of the housing 16 of the manifold 18 of this invention is free of insulation. The insulating elements 10 and 12 are of the same construction, as shown in FIG. 3.

In the installed position of the liner 6 within the housing 16, means such as bolts 42 are provided for connecting the manifold 18 to the engine(not shown).

The liner 6 of this invention is formed of ceramic material, preferably a silicon nitride, more preferably Reaction Bonded Silicon Nitride(RBSN). The housing 16 of this invention is preferably formed of metal, preferably cast iron. The housing 15 can be cast about a core formed of the liner 6, the insulating elements 10,12, and the outer metallic support ring 2. The insulating elements 10,12, preferably with the outer metallic support ring 2, is sealed to a sand mold box both to locate the ceramic liner within the casting as well as prevent the iron from seeping around the ends of the manifold liner and contacting the ceramic. The metallic ring 2 preferably stainless steel, also serves to vent the air from the insulation into the sand core. The venting has shown to be necessary in all previous castings to prevent large porosity defects. As previously stated, the metallic ring 2 may be either a split ring or solid ring design, and it is a non-contact ring.

Other materials suitable for the housing 16 are aluminum and organic plastic. The liner 6 is preferably a thin walled ceramic liner produced by slip casting.

Figure 5:
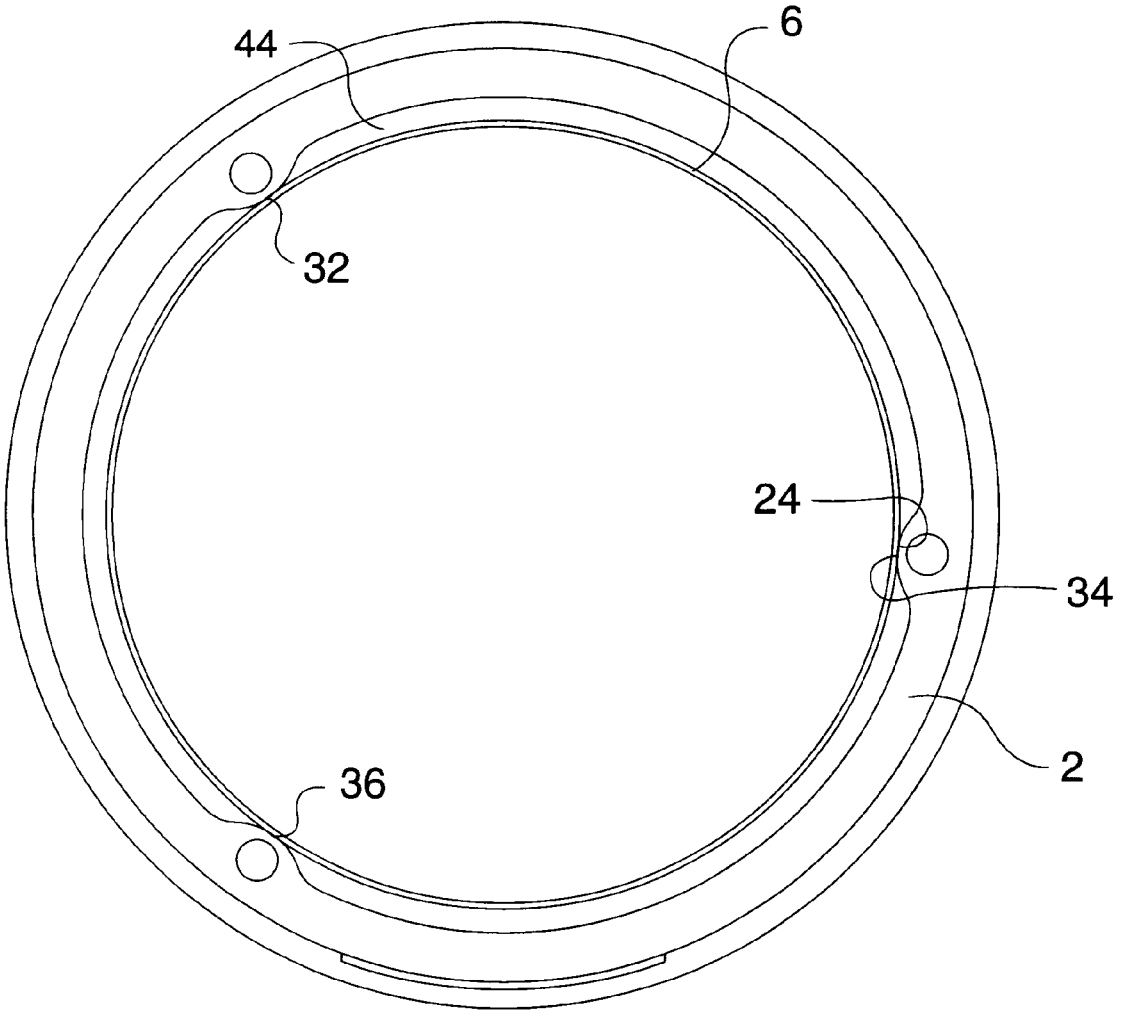
FIG. 5 is a top view of a non-contact metallic support ring assembled with a liner in accordance with the invention.

Referring to FIG. 5, a gap 44 remaining in the non-contact single ring construction may be filled after casting with a phosphate cement. A larger clearance can machined between the ceramic liner 6 and the metallic ring 2, or more preferably, the ceramic could be utilized as-fired, with increased clearance. This increased clearance allows the ring 2 to drift during the casting process with no contact with the ceramic liner 6. The mobility is limited by three locator points 32,34,36 on the inner diameter 4 of the ring.

The three locator points 32,34,36 are machined to create a gap of about 0.20 mm to 0.50 mm, more preferably about 0.375 mm. The remaining clearance at the points between each locator point is in the range of about 2.00–5.00 mm, more preferably about 3.375 mm, which provides venting for the insulation. FIG. 6 depicts the cross-sectional view of the non-contact ring.

In this other embodiment, after the metal has been cast around the ceramic liner 6, insulating elements 10,12, and the metallic support ring 2, the clearance will be filled with phosphate cement filled with mullite. The mullite filler will give the cement an expansion of about $5\times10^{-6}$ C which is about the midpoint between the ceramic liner(about 1.5–2$\times10^{-6}$ C and the metallic ring, preferably stainless steel(about $10\times10^{-6}$ C)).

In any embodiment of this invention, the exhaust manifold or port liner is free from external insulating elements or water cooling jackets, yet is capable of maintaining the temperature of the outer surface 20 of the housing 16 within acceptable temperatures during operation of the engine. Additionally, it overcomes the problems of sealing, venting and support during and after casting.

INDUSTRIAL APPLICABILITY

In one aspect of the present invention, a ceramic liner assembly is adapted for use with an internal combustion engine. A tubular liner includes a body having an outer surface, which is composed entirely of a ceramic material having a low coefficient of expansion. The ceramic liner is preferably utilized in an as-fired state, i.e. no machining is necessary. An insulating layer of material including ceramic fibers substantially surrounds the outer surface. The insulation is composed of a woven fiberglass cloth with high thermal resistance, which is stitched in a quilted pattern to encapsulate the insulating layer to define a blanket removably fitted around the surface.

A first insulation layer is applied surrounding the ceramic liner. The cast iron may penetrate the seams of the insulation or push into any gaps in the insulation and stress the ceramic. To combat that potential problem, an additional layer is then applied over the seam of the inner insulation layer. This prevents the cast iron from penetrating the insulation during the casting of the iron. This eliminates the service difficulty and utilizes the insulation the lifetime of the manifold or port liner.

Finally, a metallic support ring is then installed on the outer diameter of the ceramic liner to support the liner assembly during and after casting. This ring may be either a solid ring or a split ring. It is a non-contact ring. The ring is "sealed" to the sand mold box to both locate the overall ceramic liner within the casting as well as prevent the cast iron from seeping into the ends of the manifold liner and contacting the ceramic.

The manifold or port liner of this invention is of simple construction, compact, adapts itself to flexibility in construction and is solely internally insulated and thereby provides increased durability. The insulating element is thin and thereby conveniently adapts itself for use where engine space is severely limited, as for example in most marine applications. The metallic ring provides support, venting and sealing during the casting process.

Other aspects, objects and advantages of this invention can be obtained from a study of the drawings, the disclosure and the appended claims.

We claim:

1. A liner assembly cast into metal for use within an internal combustion engine, comprising:

a tubular liner, the tubular liner composed of a ceramic material with a low coefficient of thermal expansion;

an insulating element positioned about the tubular liner, the insulating element being quilted and having ceramic fiber encased within fiberglass; and a metallic ring positioned about an outer diameter of the tubular liner to support the tubular liner during casting into a metal.

2. The liner assembly of claim 1, wherein the tubular liner is composed of a material having a low coefficient of thermal expansion in the range of between about $1\times10^{-6}$ C and $5\times10^{-6}$ C.

3. The liner assembly of claim 2, wherein the tubular liner is composed of a material which can withstand temperatures up to 1000 degrees C.

4. The liner assembly of claim 2, wherein the tubular liner is composed of a silicon nitride material.

5. The liner assembly of claim 4, wherein the tubular liner is composed of RBSN(Reaction Bonded Silicon Nitride).

6. The liner assembly of claim 2, wherein the tubular liner is composed of CMZP(Calcium-Zirconium-Magnesium-Phosphate).

7. The liner assembly of claim 2, wherein the tubular liner is composed of NZP(Sodium-Zirconium-Phosphate).

8. The liner assembly of claim 1, wherein the tubular liner has an outer surface and the insulating element covers substantially the entire outer surface of said liner.

9. The liner assembly of claim 1, wherein the ceramic fiber of the insulating element is one of alumino-silicate, mineral wool and refractory ceramic fibers.

10. The liner assembly of claim 1, wherein the ceramic fiber of the insulating element is substantially shot free alumino-silicate.

11. The liner assembly of claim 1, wherein the insulating element positioned about the tubular liner forms a blanket removably fitted around the surface.

12. The liner assembly of claim 11, wherein the blanket is stitched in a quilted pattern to define a plurality of pockets.

13. The liner assembly of claim 1, wherein a second insulating element is positioned about the first insulating element.

14. The liner assembly of claim 13, wherein the ceramic fiber of the insulating element is one of alumino-silicate, mineral wool and refractory ceramic fibers.

15. The liner assembly of claim 13, wherein the ceramic fiber of the insulating element is substantially shot free alumino-silicate.

16. The liner assembly of claim 1, wherein the metallic ring is installed to support the tubular liner cast into metal.

17. The liner assembly of claim 16, wherein the metallic ring is a split ring.

18. The liner assembly of claim 16, wherein the metallic ring is a solid ring.

19. The liner assembly of claim 16, wherein the metallic ring is a non-contact ring.

20. The liner assembly of claim 1, wherein the tubular liner, the insulation element, and the metallic ring are subsequently cast into an iron housing.

* * * * *